United States Patent [19]

Schmitz

[11] 4,276,763

[45] Jul. 7, 1981

[54] METHOD OF ROLLING ANGULAR PROFILES HAVING FLANGES OF EQUAL LENGTH

[75] Inventor: Fernand Schmitz, Lorentzweiler, Luxembourg

[73] Assignee: ARBED, Acieries Reunies de Burbach-Eich-Dudelange, Societe Anonyme, Luxembourg, Luxembourg

[21] Appl. No.: 54,792

[22] Filed: Jul. 5, 1979

[30] Foreign Application Priority Data

Aug. 17, 1978 [LU] Luxembourg ..... 80119

[51] Int. Cl.[3] ..... B21B 1/08

[52] U.S. Cl. ..... 72/234; 72/366

[58] Field of Search ..... 72/234, 199, 181, 366, 72/226, 221

[56] References Cited

U.S. PATENT DOCUMENTS

| | | | |
|---|---|---|---|
| 652,709 | 6/1900 | Baker | 72/221 X |
| 817,344 | 4/1906 | Slick | 72/181 X |
| 817,345 | 4/1906 | Slick | 72/181 X |
| 1,584,378 | 3/1940 | Penkala | 72/234 |
| 2,193,737 | 5/1926 | Jones | 72/234 |

FOREIGN PATENT DOCUMENTS

| | | | |
|---|---|---|---|
| 1343889 | 10/1963 | France | 72/234 |
| 1433460 | 2/1966 | France | 72/234 |

OTHER PUBLICATIONS

"Stahl & Eisen," 26 Jan. 1928, pp. 97–101.

"Stahl & Eisen, " 5 Jan. 1952, pp. 279–283.

"Umschau in Technik und Betneb," #13–15, Feb. 1966, pp. 729–730.

*Primary Examiner*—Milton S. Mehr

*Attorney, Agent, or Firm*—Karl F. Ross

[57] ABSTRACT

A method of rolling angular structural shapes with flanges of equal width, especially from steel, in which a substantially round bar or billet is rolled in a first pass to a generally flat intermediate shape having a planar side and a side formed centrally with an upstanding triangular cross-section protuberance. Thereafter, in one or more passes, preferably no more than three passes, the blank is rolled to the angular profile in which the vertex is formed by the protuberance.

9 Claims, 6 Drawing Figures

METHOD OF ROLLING ANGULAR PROFILES HAVING FLANGES OF EQUAL LENGTH

CROSS REFERENCE TO RELATED APPLICATION

This application is related to the concurrently filed, commonly assigned application Ser. No. 055,038 filed July 2, 1979 in which I disclose certain improvements in the field of rolling structural shapes which have relevance to the present application.

FIELD OF THE INVENTION

My present invention relates to a method of rolling structural shapes, namely, angles having flanges of equal width, especially from steel.

BACKGROUND OF THE INVENTION

Structural shapes such as angle-profile bars, frequently referred to as angle profiles, can have flanges of equal width or, in terms of the cross section or profile, of equal length, lying at right angles to one another at a vertex.

In general, such structural shapes have radiused junctions at the inside of the vertex and rounded free ends along the inner edges of the flanges while the backs of the flanges, forming the exterior of the profile, meet at a relatively sharp right angle.

Depending upon the loading to which the structural shape is to be subjected, the flange widths and thicknesses can be varied.

The common method of fabricating such structural shapes is by multi-pass rolling in which a steel or iron bar is passed between pairs of rolls with shapes corresponding to the shapes to be imparted to the steel bar at each pass whereby the cross section of the bar is reduced, the bar is lengthened and ultimately the desired angle profile is imparted to the bar.

As will be described in greater detail hereinafter with reference to the initial FIGURES of the drawing, the conventional rollimg methods used heretofore, since the turn of the century, have been relatively complex in spite of the ultimately simple shape of the angle profile. Complicated rolling processes require large numbers of roll stands and for various sizes of the angle profiles, corresponding adjustments in roll spacing, etc. In general, therefore, the rolling cost is significant, the operation is time consuming, and the process is labor intensive.

In earlier systems, the starting billet or bar is of generally rectangular profile and is rolled with cross section reduction in seven or nine steps to the desired angle profile. During most of these steps, the thickness of the "wings" formed to either side of a central triangular or pointed protuberance, is reduced while the protuberance is repeatedly reshaped until it more closely approximates a right angle at its outer flanks so that it can form the vertex of the angle profile.

This was the state of the art insofar as commercial applications of rolling processes to the formation of angle profiles was concerned until my development of a simplified rolling process as described in the aforementioned copending application, which process has not heretofore become part of the prior art. In this application and improved process, a rectangular bar is rolled in a first step to a flat blank having, in the case of angle profiles of equal flange width, a rounded central hump which is of semicircular cross section. In a second step this blank is rolled to reduce the thickness of the wings and impart the right angle configuration to the hump. In a third step the lower outer edges of the wings are rounded and, finally, in a fourth step the wings are bent into the angle configuration in which they assume a right angle with one another.

The advantage of this latter approach is that it markedly reduces the number of passes which have been considered necessary for the rolling of angle profiles, indeed a surprising phenomenon when it is considered that earlier systems have almost unanimously recognized that commercial application required at least seven to nine steps of the type described.

OBJECTS OF THE INVENTION

It is the principal object of the present invention to provide an improved method of rolling equal-flange-width angle profiles whereby the disadvantages of prior art systems are avoided and a substantial reduction in the number of rolling passes may be obtained.

Yet another object of this invention is to improve upon the principles of the above described copending application and further reduce the number of rolling passes for producing angle structural shapes with equal-width flanges.

SUMMARY OF THE INVENTION

These objects and others which will become apparent hereinafter are obtained, in accordance with the present invention, in a method of rolling angle profiles or structural shapes with flanges of equal width in which the starting boy is a substantially round bar which is rolled in a first pass to a generally flat blank directly having a triangular protuberance with substantially right-angle flanks centrally of the blank and a pair of wings extending outwardly from the center thereof.

This blank is then rolled to bend the wings into flanges at right angles to one another to form the angle profile.

According to a feature of the invention, the blank formed in a single pass of the substantially round bar is bent to angle profile configuration directly without interposition of additional rolling steps. In other embodiments, one or two additional rolling passes are used to vary the thickness and width of the wings, as required, prior to bending the blank into the angle profiles in the final rolling pass. At most, therefore, four rolling steps are required although it is usually possible to utilize only two or three rolling steps as has been indicated.

The invention is based upon my discovery, quite surprising in light of developments heretofore in the art, that the generally round shapes of the starting bar facilitates the formation of the triangular protuberance in a single rolling pass while enabling the bar to be flattened to the appropriate width forming an angle profile upon simple bending.

The term "substantially round" or "generally round" is used here to refer to the cross section of the bar which may be circular, somewhat oval, hexagonal or octagonal. In my investigation into this phenomenon, I have found, quite surprisingly, that these substantially round bars perform, from a point of view of rolling, quite similarly to the flat blank with the semicircular rounded hump of the above-identified application.

One of the advantages of the process of the present invention, is the simplified construction of the rolling stands which are necessary to produce the angle profile. The first rolling pass can be effected in a rolling stand having a smooth-surface lower roll and an upper roller formed with a simple right-angle recess. Such recesses are more easily machined into the rolls of the mill than semicircular-section recesses.

According to another feature of the invention, the bar used initially for the process can be any commercially available cross section or profile within the definition given above. For example, if there is an overproduction of circular-section bar, the excess can be transformed into angle profiles in the manner described. In addition, the starting bar can be an intermediate in the fabrication of other rolled products so that a continuous product run can be maintained even if either the product or the intermediate has the generally round shape suitable for use in angle iron production and is withdrawn from the production line whenever it is produced in excess. This is especially the case, under certain circumstances, with oval-section bars which frequently are produced in excess or are unacceptable for further processing when they are made as intermediates for the fabrication of other shapes.

Any additional shaping of the blank, prior to bending, can be solely for the purpose of calibration of the thickness of the flanges or the shaping of the edges or ends thereof, or for ensuring that the product is within narrow tolerance to the extent these may apply.

BRIEF DESCRIPTION OF THE DRAWING

The above and other objects, features and advantages of the present invention will become more readily apparent from the following description, reference being made to the accompanying drawing in which.

SPECIFIC DESCRIPTION

In the accompanying drawing, illustration has been made of the rolled products, in cross section, at each of the plurality of rolling stages to which it is subject. It will be understood that, in accordance with conventional rolling principles, the rolling stands used for each pass are correspondingly shaped. Further, the diagrams are only illustrative and, naturally, the products can have different thickness and flange widths, as required, to suit the loading of the ultimate structural shape.

Figure 1:
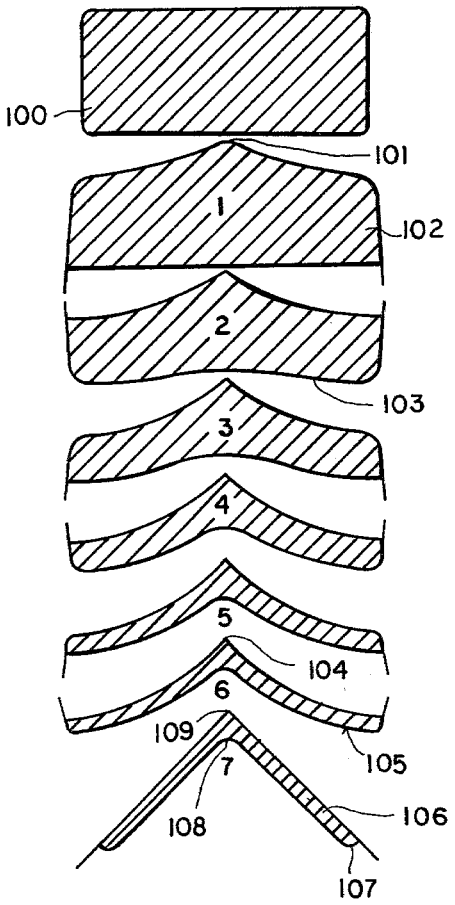
PRIOR ART FIG. 1
FIG. 1 is a diagram illustrating the successive rolling steps.

In FIG. 1 I have shown the seven-step prior-art process alluded to earlier in which a generally rectangular bar 100 is first rolled to reduce its thickness and form a slight hump 101 in the center of the bar and two relatively massive wings 102 to either side in the first pass 1 of the rolling process. This general shape is retained except that the underside 103 is given a concavity in the second pass 2 which concavity is accentuated for the blank in rolling passes 3,4 and 5. Ultimately, in rolling pass 6, the hump has a right angle section as shown at 104 and the thickness of the wings 105 are approximately the thickness of the flanges of the angle profile which is formed by bending the wings at right angles in the final rolling pass 7. The angle profile 106 has rounded edges 107 along the interiors at the free ends of the flanges and a radius at 108 at the interior of the vertex 109.

Figure 2:
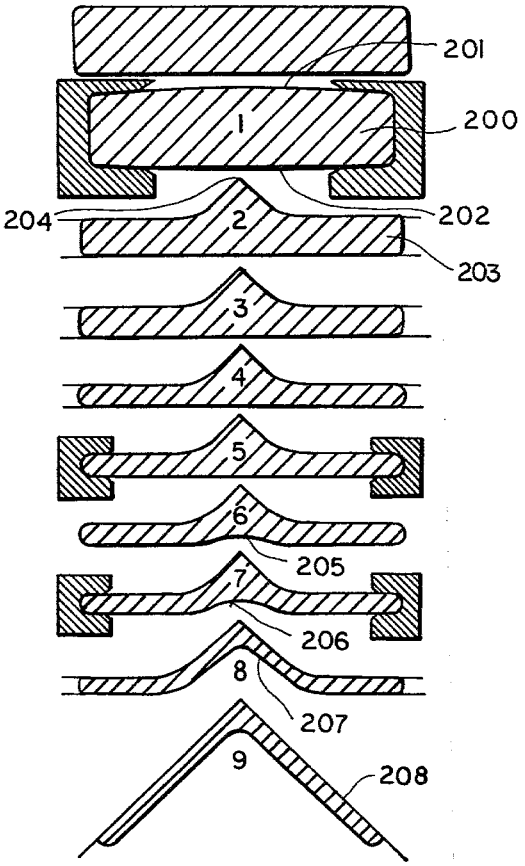
PRIOR ART FIG. 2
FIG. 2 is a diagram to FIG. 1 illustrating a nine-step technique of the prior art.

In the nine-step prior-art method of FIG. 2, the bar 200 is again generally rectangular and in a first pass is given somewhat convex upper and lower surfaces 201 and 202. A second pass reduces the thickness and forms a flat blank 203 with a triangular protuberance 204 which is retained during the subsequent passes 3–7. The last few passes 6, 7 and 8 form a concavity 205 which accentuates at 206 and 207 along the underside of the protuberance so that the final bending step 9 forms the angle profile 2081.

Figure 3:
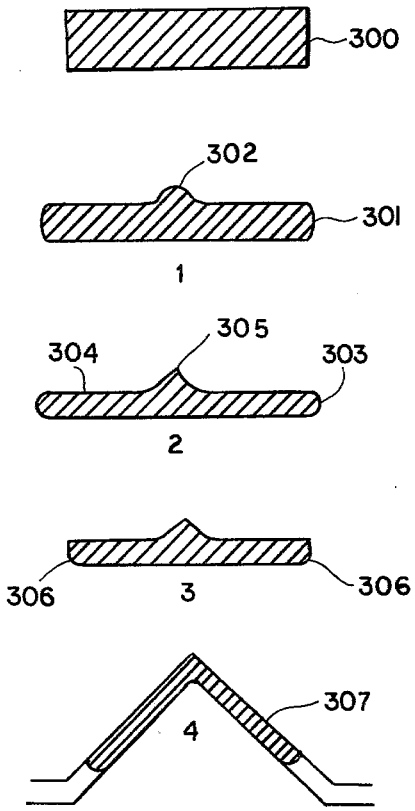
FIG. 3 is a diagram illustrating a four-step method as described in the above-identified copending application.

In a significant departure from the prior art, the system of my copending application, identified above, shown in FIG. 3 utilizes a rectangular bar 300 which in the first pass is formed into a flat blank 301 with a semicircular hump 302 at the center of this blank. In the second pass the blank is flattened to form wings 303,304 to either side of a triangular protuberance 305 whereupon the third pass forms the rounded edges 306 while the fourth pass bends the flanges into the angle profile 307.

Figure 4:
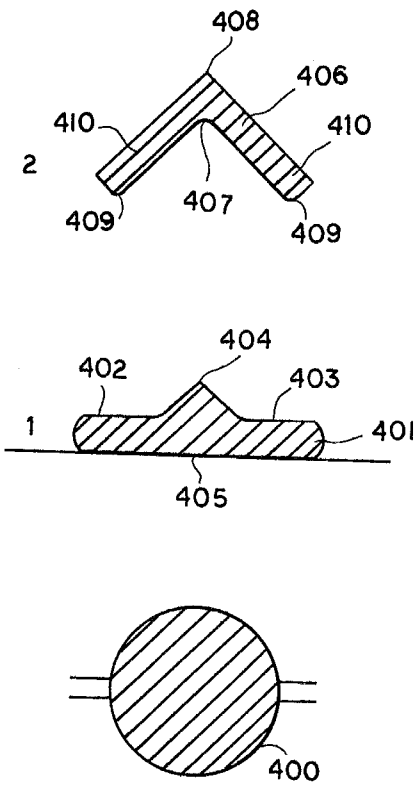
FIG. 4 is a diagram illustrating the method of the present invention in the two-step mode.

In FIG. 4 of the system of the present invention it has been shown diagrammatically that the starting body is a substantially round bar represented at 400 as a circular profile, although an oval, hexagonal or octagonal profile bar can be used as well. In the first pass 1, this bar is immediately shaped to a blank 409 with the wings 402,403 flanking the triangular protuberance 404 at the center of this bar and having a flat underside 405.

In the second pass directly, this blank 401 is rolled into the finished profile 406 with the radius 407 at the interior of the vertex 408 and with rounded inner edges 409 of the flanges 410.

Figure 5:
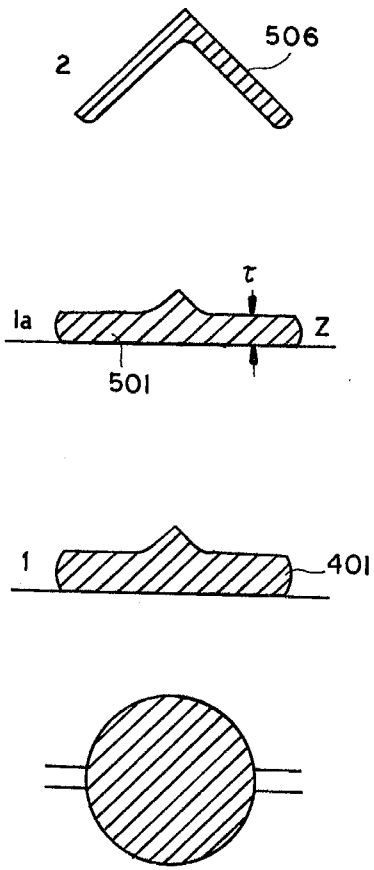
FIG. 5 is a diagram of a modification of the process shown in FIG. 4.

The same approach is used in the process of FIG. 5 in which an intermediate rolling stand represented at Z is provided to adjust the thickness t of the blank 501 before it is bent to form the profile 506.

Figure 6:
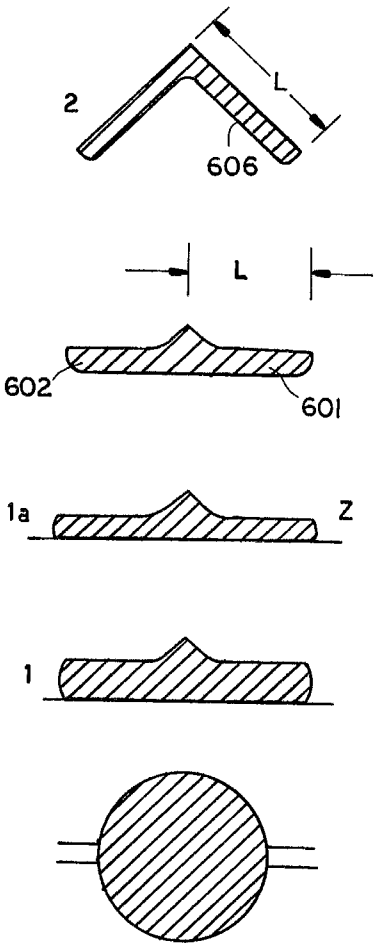
FIG. 6 is another diagram illustrating the invention.

In the system of FIG. 6, a further stand S is provided to adjust the width L of the flanges and impart a round configuration at 602 to the blank 601 before it is bent to form the angle profile 606.

I claim:

1. A method of rolling an angle structural shape having a pair of flanges of equal width, at right angles to one another, consisting of the following steps of:

initially rolling a bar of round cross section in a single rolling pass to form a flattened blank having a central protuberance of angular cross section centrally of the blank wih the external flanks of said protuberance lying at substantially right angles to one another and with said blank having a pair of wings lying to opposite sides of said protuberance; and bending said blank, in a single pass by rolling same with interposition of at most two rolling passes in which the blank remains flat while the thickness thereof is reduced, so that said wings lie substantially at a right angle to one another to form said flanges while said protuberance forms a vertex of the resulting angle structural shape.

2. The method defined in claim 1 wherein the bending pass directly follows the initial rolling of said blank without interposition of thickness reducing passes.

3. The method defined in claim 1, further comprising the step of rolling said blank with interposition of only one roling pass prior to the bending pass to adjust the thickness of said wings.

4. The method defined in claim 1 wherein said substantially round cross section is a circular cross section.

5. The method defined in claim 1 wherein said substantially round cross section is an oval cross section.

6. The method defined in claim 1 wherein said substantially round cross section is a hexagonal cross section.

7. The method defined in claim 1 wherein said substantially round cross section is an octagonal cross section.

8. The method defined in claim 1 wherein said bar is a commercial steel shape.

9. The method defined in claim 1 wherein said bar is a steel shape formed as an intermediate in the production of other steel shapes.

* * * * *